US009915251B2

(12) United States Patent
Coldren et al.

(10) Patent No.: US 9,915,251 B2
(45) Date of Patent: Mar. 13, 2018

(54) FUEL SYSTEM HAVING SERIALLY ARRANGED IN-TANK PUMPS

(71) Applicant: Caterpillar Inc., Peoria, IL (US)

(72) Inventors: Dana R. Coldren, Secor, IL (US); Joshua W. Steffen, El Paso, IL (US)

(73) Assignee: Caterpillar Inc., Peoria, IL (US)

( * ) Notice: Subject to any disclaimer, the term of this patent is extended or adjusted under 35 U.S.C. 154(b) by 291 days.

(21) Appl. No.: 14/669,259

(22) Filed: Mar. 26, 2015

(65) Prior Publication Data

US 2016/0281697 A1 Sep. 29, 2016

(51) Int. Cl.

| | |
|---|---|
| ***F04B 23/14*** | (2006.01) |
| ***F04D 13/06*** | (2006.01) |
| ***F04B 17/03*** | (2006.01) |
| ***F04D 7/02*** | (2006.01) |
| ***F04D 13/12*** | (2006.01) |
| ***F04B 23/02*** | (2006.01) |
| ***F04B 23/10*** | (2006.01) |
| *F04B 15/08* | (2006.01) |

(52) U.S. Cl.

CPC ..... *F04B 17/03* (2013.01); *F04B 15/08* (2013.01); *F04B 23/021* (2013.01); *F04B 23/106* (2013.01); *F04D 7/02* (2013.01); *F04D 13/06* (2013.01); *F04D 13/12* (2013.01); *F04B 2015/081* (2013.01)

(58) Field of Classification Search

CPC . F04D 7/02; F04D 13/06; F04D 13/12; F04B 23/14; F04B 17/03; F04B 2015/081

USPC ..... 417/203

See application file for complete search history.

(56) References Cited

U.S. PATENT DOCUMENTS

| | | | | |
|---|---|---|---|---|
| 3,304,882 A | | 2/1967 | Yearout | |
| 3,666,381 A | * | 5/1972 | Ulm | H02K 5/132 417/423.3 |
| 4,300,347 A | * | 11/1981 | Smith | F02C 9/263 60/39.281 |
| 4,639,197 A | * | 1/1987 | Tornare | F04B 3/00 417/259 |
| 5,183,392 A | | 2/1993 | Hansen | |
| 5,511,955 A | | 4/1996 | Brown et al. | |
| 5,575,626 A | | 11/1996 | Brown et al. | |
| 6,898,940 B2 | | 5/2005 | Gram et al. | |

(Continued)

FOREIGN PATENT DOCUMENTS

| | | |
|---|---|---|
| EP | 1 005 607 | 6/2000 |
| EP | 1314927 A1 | 5/2003 |

(Continued)

*Primary Examiner* — Devon Kramer
*Assistant Examiner* — Connor Tremarche
(74) *Attorney, Agent, or Firm* — Finnegan, Henderson, Farabow, Garrett & Dunner, LLP

(57) ABSTRACT

A pump system is disclosed for use with a fuel system of an engine. The pump system may have a first pump with a first end, a second end, a reservoir located at the second end, and at least one pump mechanism configured to receive fluid from the reservoir. The pump system may also have a second pump mounted to the first pump at the second end and having at least one pump mechanism configured to discharge fluid into the reservoir of the first pump. The pump system may further have a mechanical input operatively connected to the at least one pump mechanism of each of the first and second pumps.

15 Claims, 2 Drawing Sheets

(56) References Cited

U.S. PATENT DOCUMENTS

| | | | | |
|---|---|---|---|---|
| 6,904,896 | B2 | 6/2005 | Ricco et al. | |
| 7,284,543 | B2 | 10/2007 | Kato et al. | |
| 7,293,418 | B2 * | 11/2007 | Noble | F17C 3/08 62/50.1 |
| 2003/0143091 | A1 | 7/2003 | Dong | |
| 2005/0066649 | A1 * | 3/2005 | Lorenz | F02C 9/30 60/39.281 |
| 2007/0020131 | A1 | 1/2007 | Schroeder et al. | |
| 2008/0226463 | A1 * | 9/2008 | Batenburg | F02M 21/06 417/32 |
| 2011/0290220 | A1 | 12/2011 | Cippitani et al. | |
| 2013/0283824 | A1 | 10/2013 | Madison | |
| 2014/0165579 | A1 * | 6/2014 | Selstad | F01D 21/003 60/772 |

FOREIGN PATENT DOCUMENTS

| | | | |
|---|---|---|---|
| JP | 09158802 | | 6/1997 |
| JP | 2003293883 | A | 10/2003 |
| KR | 100639892 | B1 | 10/2006 |
| WO | 2016112462 | A1 | 7/2016 |

* cited by examiner

FUEL SYSTEM HAVING SERIALLY ARRANGED IN-TANK PUMPS

TECHNICAL FIELD

The present disclosure relates generally to a fuel system and, more particularly, to a fuel system having serially arranged in-tank pumps.

BACKGROUND

Gaseous fuel powered engines are common in many applications. For example, the engine of a locomotive can be powered by natural gas (or another gaseous fuel) alone or in combination with another liquid or gaseous fuel (e.g., diesel fuel). Natural gas may be more abundant and, therefore, less expensive than other liquid fuels. In addition, natural gas may burn cleaner in some applications, and produce less greenhouse gas.

Natural gas, when used in a mobile application, may be stored in a liquid state onboard the associated machine. This may require the natural gas to be stored at cold temperatures, typically about −100 to −162° C. The liquefied natural gas is then drawn from the tank by gravity and/or by a boost pump, and directed to a high-pressure pump. The high-pressure pump further increases a pressure of the fuel and directs the fuel to the machine's engine. In some applications, the liquid fuel may be gasified prior to injection into the engine and/or used in conjunction with diesel fuel (or another fuel) before combustion.

An exemplary fuel system used to pump cryogenic fluids is disclosed in U.S. Patent Application Publication No. 2013/0283824 (the '824 publication) of Madison that published on Oct. 31, 2013. In particular, the '824 publication discloses a configuration of cryogenic pumps used to pump LNG. A single liquid vessel is provided, and two electrically driven centrifugal-type pumps are disposed in series with each other, inside of vessel. Each pump is provided with its own shaft, and the two pumps are operated at different speeds. A lower of the two pumps in the vessel draws in fluid directly from the vessel, and discharges the fluid to an intake of an upper of the two pumps. A high-pressure liquid inlet provides fluid to the vessel, and a two-phase outlet is connected to the upper pump. The pumps hang from a top support plate surrounding the vessel.

While the pump configuration of the '824 publication may be acceptable in some applications, it could have limited applicability. In particular, centrifugal type pumps may not be capable of generating pressures high enough for some applications. In addition, it may be difficult in some applications to supply each of the pumps with electrical power and to separately control the speeds of the pumps. Further, drawing fluid directly from the tank may allow for contamination and/or damage of the pumps.

The disclosed fuel system is directed to overcoming one or more of the problems set forth above.

SUMMARY

In one aspect, the present disclosure is directed to a pump system. The pump system may include a first pump having a first end, a second end, a reservoir located at the second end, and at least one pump mechanism configured to receive fluid from the reservoir. The pump system may also include a second pump mounted to the first pump at the second end and having at least one pump mechanism configured to discharge fluid into the reservoir of the first pump. The pump system may further include a mechanical input operatively connected to the at least one pump mechanism of each of the first and second pumps.

In another aspect, the present disclosure is directed to another pump system. This pump system may include a fluid tank; and a piston pump having a first end mounted to the fluid tank, and a second end hanging inside the fluid tank. The pump system may further include a centrifugal pump mounted to the second end of the piston pump and configured to transfer fluid from the fluid tank to the piston pump.

In yet another aspect, the present disclosure is directed to fuel system. The fuel system may include a fuel tank, and a piston pump having a first end mounted to the fuel tank, a second end hanging inside the fuel tank, and a plunger configured to pressurize liquid fuel received from a reservoir located at the second end. The fuel system may also include a centrifugal pump mounted to the second end of the piston pump and configured to transfer liquid fuel from the fuel tank into the reservoir of the piston pump, and a filter disposed at an inlet of the centrifugal pump inside the fuel tank. The fuel system may further include a shaft extending into the fuel tank and configured to operatively drive the piston and centrifugal pumps, and an external electric motor operatively connected to the shaft. The fuel system may additionally include a vaporizer configured to receive pressurized liquid fuel from the piston pump and to vaporize the pressurized liquid fuel, an accumulator configured to receive vaporized fuel from the vaporizer, and a regulator located downstream of the accumulator.

DETAILED DESCRIPTION

Figure 1:
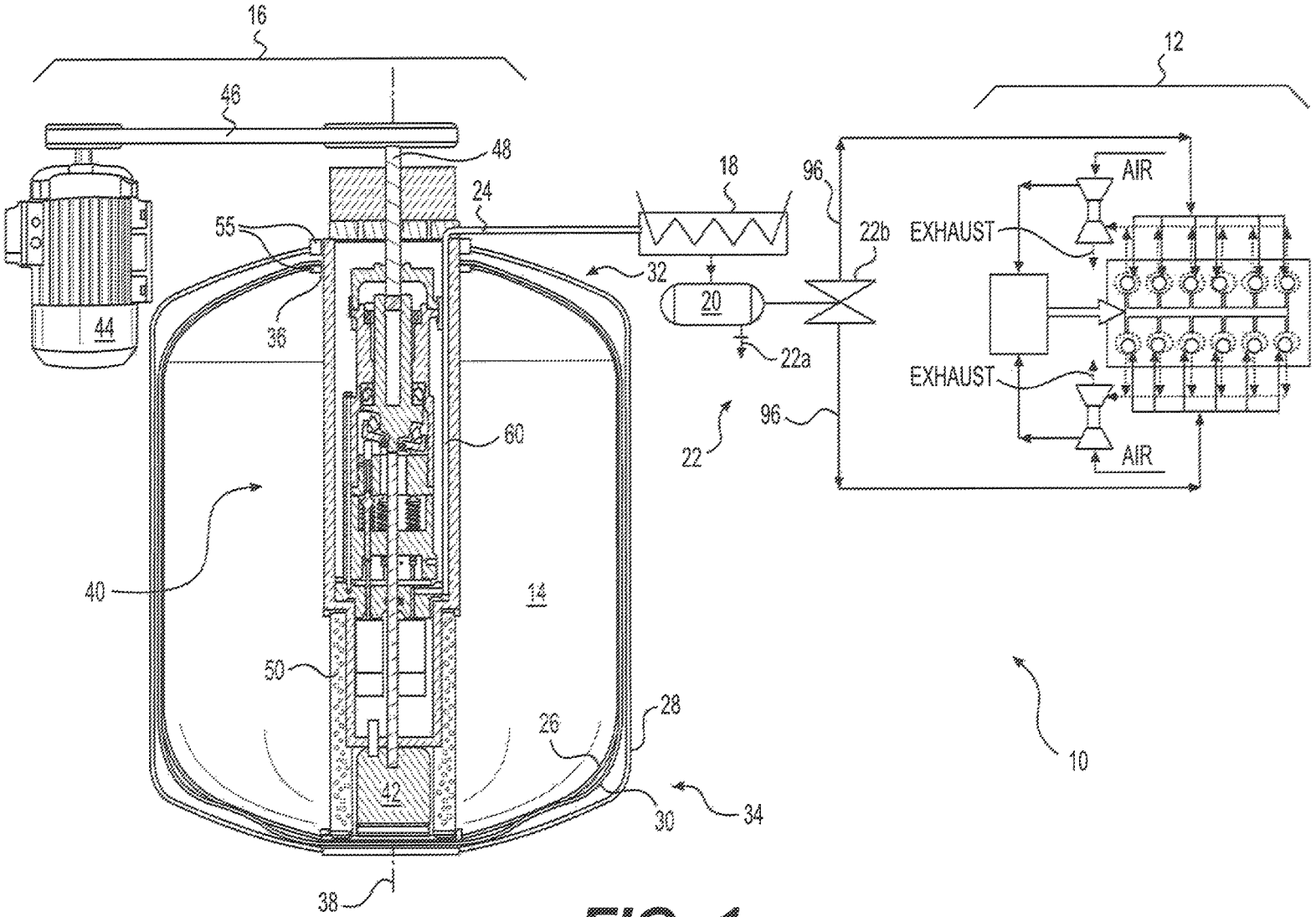
FIG. 1 is a cross-sectional and diagrammatic illustration of an exemplary fuel system.

FIG. 1 illustrates an exemplary fuel system 10 having multiple components that cooperate to provide a gasified fuel (e.g., natural gas) to an engine 12 in a regulated manner. These components may include, among other things, a fuel tank ("tank") 14, a pump system 16, a vaporizer 18, a high-pressure accumulator ("accumulator") 20, and one or more pressure reducing devices 22 (e.g., a vent 22*a* and a regulator 22*b*). Liquid fuel (e.g., liquefied natural gas—LNG) may be stored in tank 14, and pump system 16 may draw in and pressurize the liquid fuel from tank 14. The pressurized liquid fuel may be directed via a passage 24 to vaporizer 18, which may then heat and thereby vaporize the fuel. Accumulator 20 may be located downstream of vaporizer 18 and configured to collect and store gaseous fuel for future use by engine 12. Pressure reducing devices 22 may selectively reduce a pressure of the gaseous fuel to a desired pressure before passing the gaseous fuel to engine 12. It should be noted that the gaseous fuel may be provided to engine 12 alone or together with another fuel (e.g., a liquid fuel, such as diesel, if desired).

Tank 14 may be a cryogenic tank configured to hold the natural gas in its liquefied state. In the exemplary embodiment, tank 14 has an inner wall 26 separated from an outer wall 28 by an air gap. In some embodiments, an insulating layer 30 may be disposed in the air gap (e.g. on inner wall 26). The air gap, together with the insulating layer 30, may function to maintain a temperature of the natural gas below its boiling temperature of about −100-162° C.

Tank 14 may be generally cylindrical, having a top 32 and a bottom 34. Top 32 may have an opening 36 formed therein that passes through both of inner and outer walls 26, 28. Opening 36 may be generally aligned with a central axis 38 of symmetry. Bottom 34 may be closed.

Pump system 16 may be at least partially submerged inside of tank 14, for example inside a centralized socket formed in tank 14. In particular, pump system 16 may include a high-pressure pump 40 that is connected at a base end to tank 14 at top 32, and a boost pump 42 that hangs from a distal end of high-pressure pump 40. By being connected to tank 40 at only one end, high-pressure and boost pumps 40, 42 may be allowed to expand and contract due to normal thermal loading without inducing stresses in tank 14 that could damage tank 14. An electric motor 44 (or other power source) may be located outside of tank 14, and connected to drive both of high-pressure and boost pumps 40, 42 via a belt 46 and a mechanical input 48. In the disclosed embodiment, mechanical input 48 is a shaft. In other exemplary embodiments, however, mechanical input 48 could be a gear train, if desired. In either of these arrangements, an output rotation of motor 44 may cause belt 46 to induce a corresponding input rotation of mechanical input 48. This corresponding input rotation may be simultaneously transmitted to both of high-pressure and boost pumps 40 with equal speed.

High-pressure and boost pumps 40, 42 may be serially arranged. That is, when driven by mechanical input 48, boost pump 42 may draw liquid fuel through a filter 50, and generate a low-pressure feed directed into high-pressure pump 40. High-pressure pump 40 may then further increase the pressure of the fuel, and direct high-pressure fuel to vaporizer 18 via passage 24.

Figure 2:
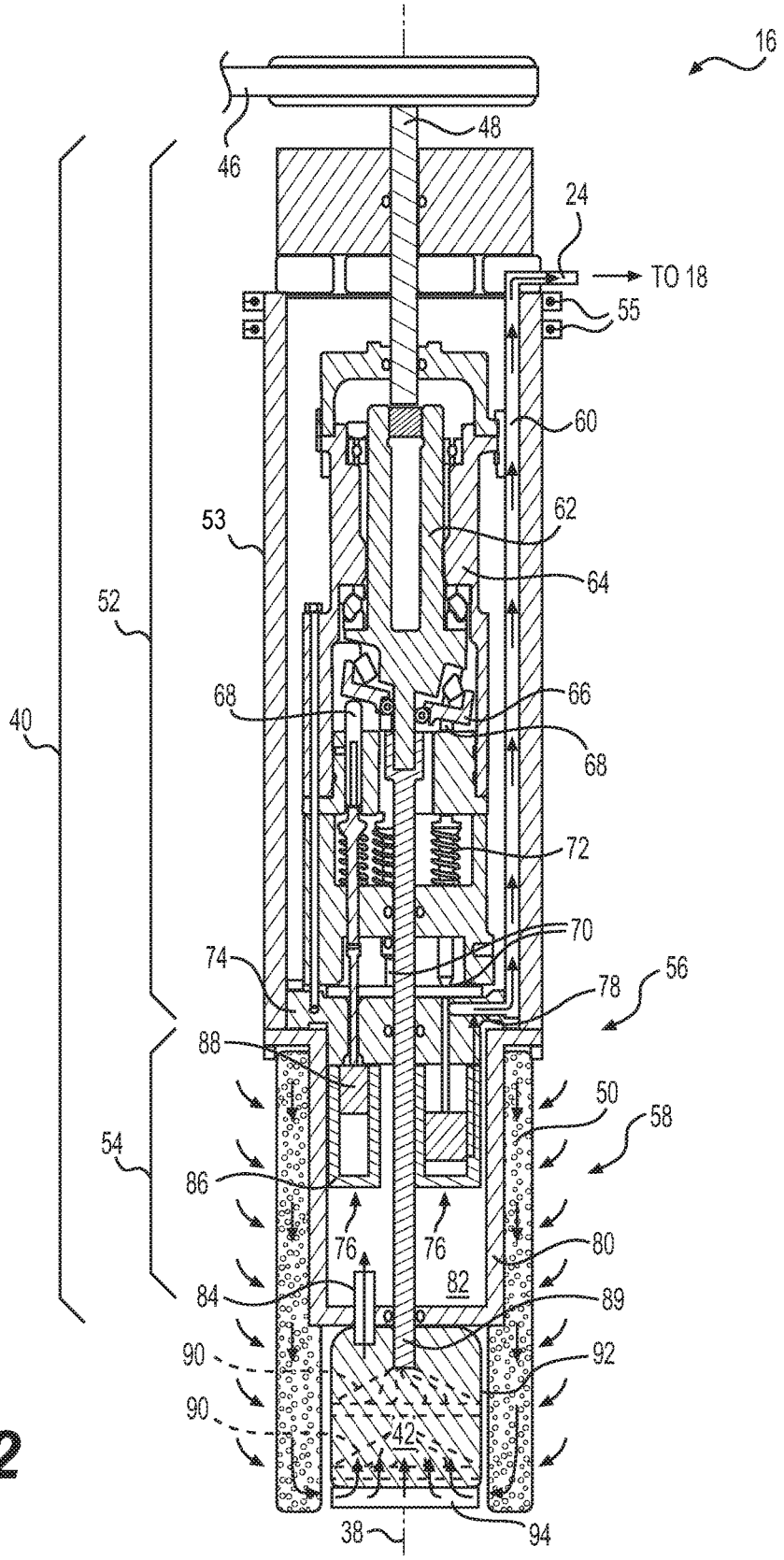
FIG. 2 is a cross-sectional illustration of an exemplary disclosed pump system that may be used in conjunction with the fuel system of FIG. 1.

An exemplary pump system 16 is shown in FIG. 2. As can be seen in this figure, high-pressure pump 40 may be generally cylindrical and divided into two ends. For example, high-pressure pump 40 may be divided into a warm or input end 52, into which mechanical input 48 extends, and a cold or output end 54 that is at least partially submerged in liquid fuel. Input end 52 may be fixedly mounted to tank 14 at top 32, for example by way of one or more mounting hardware components 55 (e.g., flanges, seals, brackets, gaskets, etc.). The pump system 16 may be mounted within the tank 14 within a socket 53 insulating and/or isolating the input end 52 from liquid fuel stored in the tank 14 at cryogenic temperatures. Input end 52 also may be insulated and/or isolated from cold end 54 (e.g., encased in vacuum jacket or super insulated liner that inhibits heat transfer). output end 54 may extend from input end 52 deeper into tank 14, and be further divided into a manifold section 56 and a reservoir section 58. Each of these sections may be generally aligned with mechanical input 48 along axis 38 and connected end-to-end. With this configuration, the input rotation provided to high-pressure pump 40 at input end 52 (i.e., via mechanical input 48) may be used to generate a high-pressure fuel discharge at the opposing output end 54. The high-pressure fuel discharge may be directed back up to input end 52 via a passage 60 to exit tank 14 at opening 36 (referring to FIG. 1) In most applications, high-pressure pump 40 will be mounted and used in the orientation shown in FIGS. 1 and 2 (i.e., with reservoir section 58 being located gravitationally lowest).

High-pressure pump 40 may be an axial piston type of pump. In particular, a pump shaft 62 may be rotatably supported within a housing 64, and connected at a top end to mechanical input 48 (e.g., via a splined interface) and at a bottom end to a load plate 66. Load plate 66 may be oriented at an oblique angle relative to axis 38, such that the input rotation of shaft 62 may be converted into a corresponding undulating motion of load plate 66. A plurality of tappets 68 may slide along a lower face of load plate 66, and a push rod 70 may be associated with each tappet 68. In this way, the undulating motion of load plate 66 may be transferred through tappets 68 to push rods 70 and to plungers 88 and used to pressurize the fluid passing through high-pressure pump 40. A resilient member, for example a coil spring 72, may be associated with each push rod 70 and configured to bias the associated tappet 68 into engagement with load plate 66. Each push rod 70 may be a single-piece component or, alternatively, be comprised of multiple pieces, as desired. Many different shaft/load plate configurations may be possible, and the oblique angle of shaft 62 may be fixed or variable, as desired. In the disclosed embodiment, the oblique angle of shaft 62 is fixed, and a variable output of high-pressure pump 40 is obtained via speed adjustment of motor 44 (referring to FIG. 1) based on a demand from engine 12.

Manifold section 56 of high-pressure pump 40 may include a manifold 74 that performs several different functions. In particular, manifold 74 may function as a guide for push rods 70, as a mounting pad for a plurality of pump mechanisms 76, and as a distributer/collector of fluids for pump mechanisms 76. Manifold 74 may connect to input end 52, and have formed therein a common high-pressure outlet ("outlet") 78 in fluid communication with each of pump mechanism 76.

Reservoir section 58 may include a close-ended jacket 80 connected to manifold section 56 (e.g., to a side of manifold 74 opposite input end 52) by way of a seal and/or an insulating plate (not shown) to form an internal reservoir chamber 82. Reservoir chamber 82 may be in open fluid communication with boost pump 42 via a low-pressure inlet ("reservoir inlet") 84. In some embodiments, a check valve (not shown) may be installed at reservoir inlet 84 to ensure unidirectional flow into reservoir 82, if desired.

Any number of pump mechanisms 76 may be connected to manifold 74 and extend into reservoir 82. As shown in FIG. 2, each pump mechanism 76 may include a generally hollow barrel 86 having an open end connected to manifold 74 and an opposing closed end. A lower portion of each push rod 70 may extend through manifold 74 and the open end of a corresponding barrel 86 to engage a free-floating plunger 88. In this way, an extending movement of push rod 70 may translate into a downward sliding motion of plunger 88 toward a Bottom-Dead-Center (BDC) position. A pressure of the fluid in reservoir 82 and in barrel 86 created by boost pump 42 may help to return plunger 88 to a Top-Dead-Center (TDC) position as push rod 70 is retracted from barrel 86.

One or more valve elements (not shown) that facilitate fluid pumping during the motion of plungers 88 between BDC and TDC positions may be housed within the closed end (e.g., within a head portion) of barrel 86. The valve element(s) may include, for example, one or more check valves that allow fuel from reservoir 82 to enter barrel 86 during the retracting motion of push rods 70, and that direct high-pressure fluid from barrel 86 to passage 60 during the extending motion of push rods 70. The high-pressure discharge from all pump mechanisms 76 may join each other inside manifold 74 for discharge from high-pressure pump 40 via high-pressure outlet 78 and passage 60.

Boost pump 42 may embody a centrifugal type pump hanging from the distal end of high-pressure pump 40. In particular, boost pump 42 may have a closed end mounted to the distal end of high-pressure pump 40, and an open end located opposite the closed end and nearest a bottom of tank 14. The open end may be at least partially submerged within tank 14. A shaft 89 may be connected to shaft 62 of high-pressure pump 40 (e.g., via a splined interface), and also connected with one or more impellers 90 located inside a volute housing 92 of boost pump 42. In this configuration, the input rotation of mechanical input 48 may be transmitted through shaft 62 of high-pressure pump 40 and shaft 89 of boost pump 42 to impeller(s) 90, causing impeller(s) 90 to rotate. As impeller(s) 90 rotates, fuel from inside tank 14 may be drawn through filter 50 into a suction nozzle 94 of volute housing 92 at the open end of boost pump 42. Impeller(s) 90 may increase a pressure of the fuel and direct the pressurized fuel through inlet 84 into reservoir 82. The pressure achieved by boost pump 42 may be sufficient to push plungers 88 back to their TDC positions as push rods 70 are retracted.

Filter 50 may be a generally hollow and porous sleeve that is placed around boost pump 42. In some embodiments, filter 50 may also extend a distance over output end 54 so as to increase a flow area through filter 50. A top end of filter 50 may annularly seal against an outer surface of the reservoir section 58 of output end 54 of high-pressure pump 40, and a lower end of filter 50 may seal against the bottom surface of tank 14, such that unfiltered fuel may not flow around ends of filter 50. In the disclosed embodiment, filter 50 is fabricated from a stainless steel mesh having openings with a diameter of about 3-4 microns, although other types of filters (e.g., edge filters ceramic filters, sintered metal filters, etc.) could be utilized.

Vaporizer 18 (referring back to FIG. 1) may embody any conventional type of fuel heater known in the art. For example, vaporizer 18 may be a heat exchanger, wherein the liquid fuel from pump system 16 is directed through vaporizer 18 to absorb heat from another fluid (e.g., from engine exhaust, from ambient air, from engine coolant, etc.). This absorbed heat may be sufficient to vaporize the liquid fuel before it is collected inside accumulator 20. It is contemplated, however, that other types of heaters may be used to vaporize the liquid fuel, if desired, such as electric- or fuel-powered heaters.

Accumulator 20 may embody a high-pressure vessel configured to store pressurized natural gas for future use by engine 12. As a pressure of the natural gas from vaporizer 18 exceeds a pressure of accumulator 20, the natural gas may flow into accumulator 20. Because the natural gas therein is compressible, it may act like a spring and compress as more natural gas flows in. When the pressure of the natural gas at an outlet of accumulator 20 drops below the pressure inside of accumulator 20, the compressed natural gas may expand and exit accumulator 20. It is contemplated that accumulator 20 may alternatively embody a membrane/spring-biased or bladder type of accumulator, if desired.

Vent 22*a* and regulator 22*b*, while used for different purposes, may function in a similar way. Specifically, vent 22*a* may be configured to selectively allow gaseous fuel to discharge from accumulator 20 to the atmosphere in a controlled manner (i.e., at a control pressure and temperature) that does not compromise the integrity of vent 22*a*. Regulator 22*b* may similarly allow gaseous fuel to discharge from accumulator 20 in a controlled manner. In contrast to vent 22*a*, however, regulator 22*b* may direct the discharging gaseous fuel to engine 12 via one or more supply lines 96. It is contemplated that vent 22*a* and regulator 22*b* may control the gaseous fuel to discharge at the same rates and pressures or at different rates and pressures, as desired. It is contemplated that regulator 22*b* may control the gaseous fuel to discharge at any desired rate and/or pressure (e.g., at a variable rate and/or pressure) demanded by engine 12.

INDUSTRIAL APPLICABILITY

The disclosed fuel system finds potential application in any mobile (e.g., locomotive) or stationary (e.g., power generation) application having an internal combustion engine. The disclosed fuel system finds particular applicability in cryogenic applications, for example applications having engines that burn LNG fuel. The disclosed fuel system may provide a high-pressure supply of gaseous fuel in a compact, simple, and robust configuration. Operation of pump system 16 will now be explained.

Referring to FIGS. 1 and 2, when mechanical input 48 is rotated by motor 44, both of high-pressure and boost pumps 40, 42 may be driven at the same speed. In particular, the rotation of mechanical input 48 may be transferred to shaft 62 of high-pressure pump 40 and from shaft 62 to shaft 89 of boost pump 42. The rotation of shaft 89 may result in a corresponding rotation of impeller 90, that functions to draw liquid fuel from deep inside tank 14 (where the fuel is coldest) through filter 50 and suction nozzle 94. Impeller 90 may elevate the pressure of this fluid and direct the fluid through inlet 84 of high-pressure pump 40 into reservoir 82, thereby filling and pressurizing reservoir 82.

At this same time, the rotation of shaft 62 may cause load plate 66 to undulate in an axial direction. This undulation may result in translational movement of tappets 68 and corresponding movements of push rods 70. As push rods 70 retract from barrels 86, the pressure of the liquid fuel in reservoir 82 may cause liquid fuel to enter barrels 86 and push plungers 88 upward. As push rods 70 extend back into barrels 86, push rods 70 may force plungers 88 downward. The downward movement of plungers 88 may push the liquid fuel from barrels 86 at an elevated pressure. The high-pressure fuel may flow through high-pressure outlet 78 into passage 60, and discharge from pump system 16 into passage 24.

The high-pressure liquid fuel may then pass through vaporizer 18, where the fuel is vaporized, before being collected in accumulator 20. The collected gaseous fuel may then be regulated into engine 12.

It should be noted that, although high-pressure and boost pumps 40, 42 may be driven at the same speed via mechanical input 48, that speed may be a function of engine demand for high-pressure fuel from only high-pressure pump 40. In other words, the speed of mechanical input 48 may be adjusted to accommodate a demand for fuel from high-pressure pump 40, and boost pump 42 may be required to maintain a minimum pressure inside reservoir 82 regardless of the speed. Accordingly, boost pump 42 may be sized (e.g., the size and/or number of impellers 90 selected, the size and shape of the volute designed, etc.) to ensure that reservoir 82 is always pressurized throughout a range of input speeds (e.g., even at a lowest speed expected). In some instances, boost pump 42 may supply more low-pressure feed than is required. In these instances, reservoir 82 may need to be selectively relieved of pressure or otherwise bypassed.

Because the disclosed fuel system may utilize two different types of pumps, benefits associated with each type of pump can be realized. For example, the simplicity and efficiency of a centrifugal type of boost pump may be coupled with the higher-pressures attainable from a piston type of pump. This combination of benefits may increase the applicability of fuel system 10. In addition, because none of the pumps of fuel system 10 may directly require electrical power to be routed to them, the mounting of the pumps inside tank 14 may be simple and robust. And because the pumps may not need to be separately speed-controlled, fuel system 10 may be even further simplified. In addition, because the liquid fuel passing through both pumps of fuel system 10 may first be filtered by a common filter, longevity of the pumps may be ensured while keeping a cost of fuel system 10 low.

It will be apparent to those skilled in the art that various modifications and variations can be made to the fuel and pump systems of the present disclosure. Other embodiments of the fuel and pump systems will be apparent to those skilled in the art from consideration of the specification and practice of the systems disclosed herein. It is intended that the specification and examples be considered as exemplary only, with a true scope being indicated by the following claims and their equivalents.

What is claimed is:

1. A pump system, comprising:

a housing, having a first end and a second end, the housing defining a longitudinal axis;

at least one plunger pump mechanism having a plunger disposed within a hollow barrel, the plunger configured for reciprocating motion within the barrel;

a jacket mounted to the second end of the housing, the jacket enclosing the at least one plunger pump mechanism and defining a reservoir chamber;

a centrifugal pump mounted to the jacket and configured to discharge fluid through a reservoir inlet into the reservoir chamber; and a shaft disposed through the housing along the longitudinal axis, the shaft operatively coupled to the at least one plunger pump mechanism and to the centrifugal pump, wherein at least the jacket defining the reservoir chamber and the centrifugal pump are mounted inside a fluid tank, and wherein an inlet to the centrifugal pump is located opposite the jacket and is open to the fluid tank, and, wherein the centrifugal pump is located gravitationally lower in the fluid tank than the at least one plunger pump mechanism.

2. The pump system of claim 1, further including an electric motor operatively connected to the shaft.

3. The pump system of claim 1, wherein the centrifugal pump is configured having more than one impeller.

4. The pump system of claim 1, further including a high-pressure outlet extending from the at least one plunger pump mechanism out of the fluid tank.

5. The pump system of claim 4 further comprising a socket disposed within an interior volume of the fluid tank, wherein the housing is positioned within the socket so that the jacket defining the reservoir chamber enclosing the at least one plunger pump mechanism and the centrifugal pump are exposed to the interior volume of the fluid tank.

6. The pump system of claim 1, further including a filter disposed at an inlet of the centrifugal pump.

7. The pump system of claim 6 wherein the filter is oriented coaxially with the longitudinal axis about the jacket and the centrifugal pump.

8. The pump system of claim 1 wherein the at least one plunger pump mechanism comprises a plurality of plunger pump mechanisms arranged radially about the longitudinal axis, each of the plurality of plunger pump mechanisms being connected to a manifold, the manifold being mounted to the housing and opposite the reservoir inlet, the manifold joining a discharge from each of the plurality of plunger pump mechanisms.

9. A pump system, comprising: a fluid tank having a socket extending into an interior volume of the fluid tank, the socket having a first end defining an opening and a second end positioned within the interior volume of the fluid tank, the socket further defining a longitudinal axis; a pump assembly partially disposed within the socket, the pump assembly including a housing having a first end positioned proximate to the first end of the socket and a second end positioned proximate to the second end of the socket, a manifold attached to the second end of the housing, a plurality of pump mechanisms attached to the manifold and arranged radially about the longitudinal axis, each of the pump mechanisms including a plunger disposed within a hollow barrel, the plunger configured for reciprocating motion within the barrel, a jacket enclosing said plurality of pump mechanisms and defining a reservoir chamber, the hollow barrel of each of the plurality of pump mechanisms being in fluid communication with the reservoir chamber, and a centrifugal pump having an inlet and an outlet, the outlet of the centrifugal pump being in fluid communication with the reservoir chamber by way of a reservoir inlet, the centrifugal pump being configured to transfer fluid from the fluid tank to the reservoir chamber so that in operation, the fluid pressure in the reservoir chamber is greater than the fluid pressure in the fluid tank; and, a shaft disposed through the housing along the longitudinal axis, the shaft operatively coupled to mechanically drive the plurality of pump mechanism and the centrifugal pump, and an electric motor operatively connected to the shaft outside of the fluid tank proximate to the first end of the housing; and a filter annularly disposed coaxially with the longitudinal axis about the jacket and the centrifugal pump, and extending between the housing and an interior surface of the fluid tank, the filter configured to permit fluid flow between the interior volume the fluid tank and the inlet of the centrifugal pump only through the filter.

10. The pump system of claim 9, further including a fluid outlet extending from the manifold out of the fluid tank, wherein the manifold joins a discharge passage of each of the plurality of pump mechanisms to the fluid outlet.

11. The pump system of claim 9 wherein the centrifugal pump is positioned gravitationally lower in the fluid tank than the plurality of pump mechanisms.

12. A fuel system, comprising: a fuel tank having a socket extending into an interior volume of the fuel tank, the socket defining a longitudinal axis; a pump assembly disposed within the socket, the pump assembly having a housing, a first end of the housing mounted to the fuel tank, a second end of the housing disposed inside the fuel tank, and at least one plunger pump mechanism having a plunger disposed within a hollow barrel, the plunger configured for reciprocating motion within the barrel, a jacket mounted to the second end of the housing, the jacket enclosing the at least one plunger pump mechanism and defining a reservoir chamber, a centrifugal pump mounted to the jacket defining the reservoir chamber and configured to transfer liquid fuel from the interior volume of the fuel tank through a reservoir inlet into the reservoir chamber, and a shaft extending along the longitudinal axis and configured to operatively drive the at least one plunger pump mechanism and the centrifugal pump; a filter annularly disposed coaxially with the longitudinal axis about the jacket and the centrifugal pump, and extending between the housing and an interior surface of the fuel tank, the filter configured to permit fuel flow between the interior volume the fuel tank and an inlet of the centrifugal pump only through the filter; an electric motor operatively connected to the shaft outside of the tank; a vaporizer configured to receive pressurized liquid fuel from the least one plunger pump mechanism and to vaporize the pressurized liquid fuel; an accumulator configured to receive vaporized fuel from the vaporizer; and a regulator located downstream of the accumulator.

13. The fuel system of claim 12 wherein the at least one plunger pump mechanism comprises a plurality of plunger pump mechanisms arranged radially about the longitudinal axis, each of the plurality of plunger pump mechanisms being connected to a manifold mounted to the housing and opposite the reservoir inlet, the manifold joining a discharge from each of the plurality of plunger pump mechanisms.

14. The fuel system of claim 13, further including a fuel outlet extending from the manifold out of the fuel tank.

15. The fuel system of claim 13, wherein the centrifugal pump is positioned gravitationally lower in the fuel tank than the plurality of plunger pump mechanisms.

* * * * *